US008133071B2

(12) United States Patent
Huang et al.

(10) Patent No.: US 8,133,071 B2
(45) Date of Patent: Mar. 13, 2012

(54) CABLE ASSEMBLY WITH FLAT CABLE

(75) Inventors: Chien-Hsun Huang, Tu-Cheng (TW); Hao Tang, Kunshan (CN); Zhi-Guo Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 55 days.

(21) Appl. No.: 12/834,910

(22) Filed: Jul. 13, 2010

(65) Prior Publication Data

US 2011/0008997 A1 Jan. 13, 2011

(51) Int. Cl.
*H01R 12/00* (2006.01)

(52) U.S. Cl. ..... 439/499

(58) Field of Classification Search ..... 439/493, 439/494, 497–499, 607.01, 607.54, 607.55, 439/607.56, 607.46, 606, 701, 719, 874, 439/942

See application file for complete search history.

(56) References Cited

U.S. PATENT DOCUMENTS 6,065,993 A * 5/2000 Lai et al. ..... 439/402
6,350,146 B1 2/2002 Chen, et al.
6,478,615 B1 11/2002 Kuo
6,773,286 B1 * 8/2004 Wu ..... 439/247
6,776,664 B1 * 8/2004 Huang ..... 439/660
6,890,200 B1 * 5/2005 Wu ..... 439/247
6,923,679 B1 * 8/2005 Wu ..... 439/573
6,945,816 B1 * 9/2005 Wu ..... 439/545
7,083,465 B2 * 8/2006 Wu ..... 439/497
7,086,888 B2 * 8/2006 Wu ..... 439/358
7,192,297 B1 * 3/2007 Wu ..... 439/358
7,462,071 B1 * 12/2008 Wu ..... 439/607.05
7,758,374 B2 * 7/2010 Yu et al. ..... 439/493
2008/0153346 A1 * 6/2008 Oesterhaus et al. ..... 439/499
2010/0190373 A1 * 7/2010 Yeh ..... 439/499

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A cable assembly includes an electrical connector, a flat cable, a flexible printed circuit electrically connecting the flat cable to the electrical connector, and a spacer fastened on the electrical connector for supporting the flexible printed circuit. The electrical connector includes an insulation housing and a plurality of terminals receiving in the housing and each of which has an tail exposed out of the housing. The flexible printed circuit includes a vertical connecting portion connected to the terminals of the electrical connector and a horizontal connecting portion separated from the vertical connecting portion and connected to one end of the flat cable.

10 Claims, 4 Drawing Sheets

CABLE ASSEMBLY WITH FLAT CABLE

BACKGROUND OF THE INVENTION

1. Field of the Invention

The present invention relates generally to a cable assembly, and more particularly to a low profile cable assembly with a flat cable.

2. Description of the Prior Art

A Video Graphics Array (VGA) connector is a common connector widely used in electric devices. For its terminals being arranged along three rows, cables, such as U.S. Pat. No. 6,350,146 B1 disclosed, connected to the terminals can only be covered by a columniform sleeve. However, present cable assembly always need cables with one end connected to the VGA connector arranged in a line for owning low profile and adapting other connectors which are connected to the other end of the cables.

Hence, in this art, a cable assembly to overcome the above-mentioned disadvantages of the prior art should be provided.

BRIEF SUMMARY OF THE INVENTION

A primary object, therefore, of the present invention is to provide a cable assembly with an improved coupling structure.

In order to implement the above object, a cable assembly comprises an electrical connector, a flat cable, a flexible printed circuit electrically connecting the flat cable to the electrical connector, and a spacer fastened on the electrical connector for supporting the flexible printed circuit. The electrical connector comprises an insulation housing and a plurality of terminals receiving in the housing and each of which has an tail exposed out of the housing. The flexible printed circuit comprises a vertical connecting portion connected to the terminals of the electrical connector and a horizontal connecting portion separated from the vertical connecting portion and connected to one end of the flat cable.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
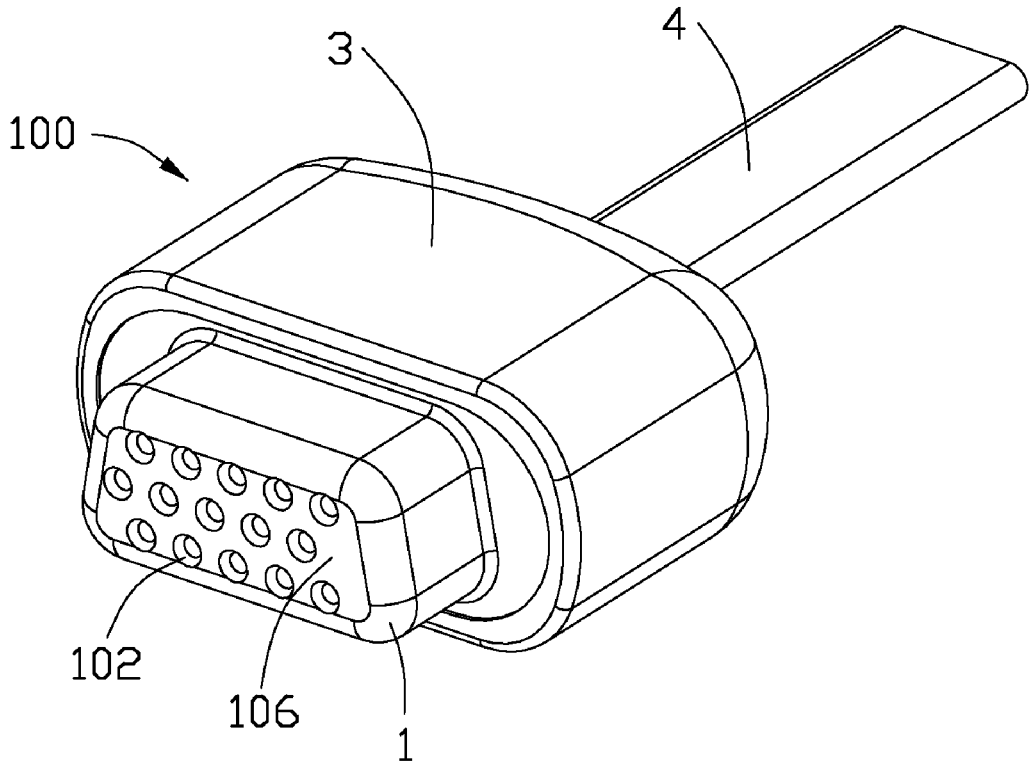
FIG. 1 is a perspective view of a cable assembly in according with the present invention.
Figure 2:
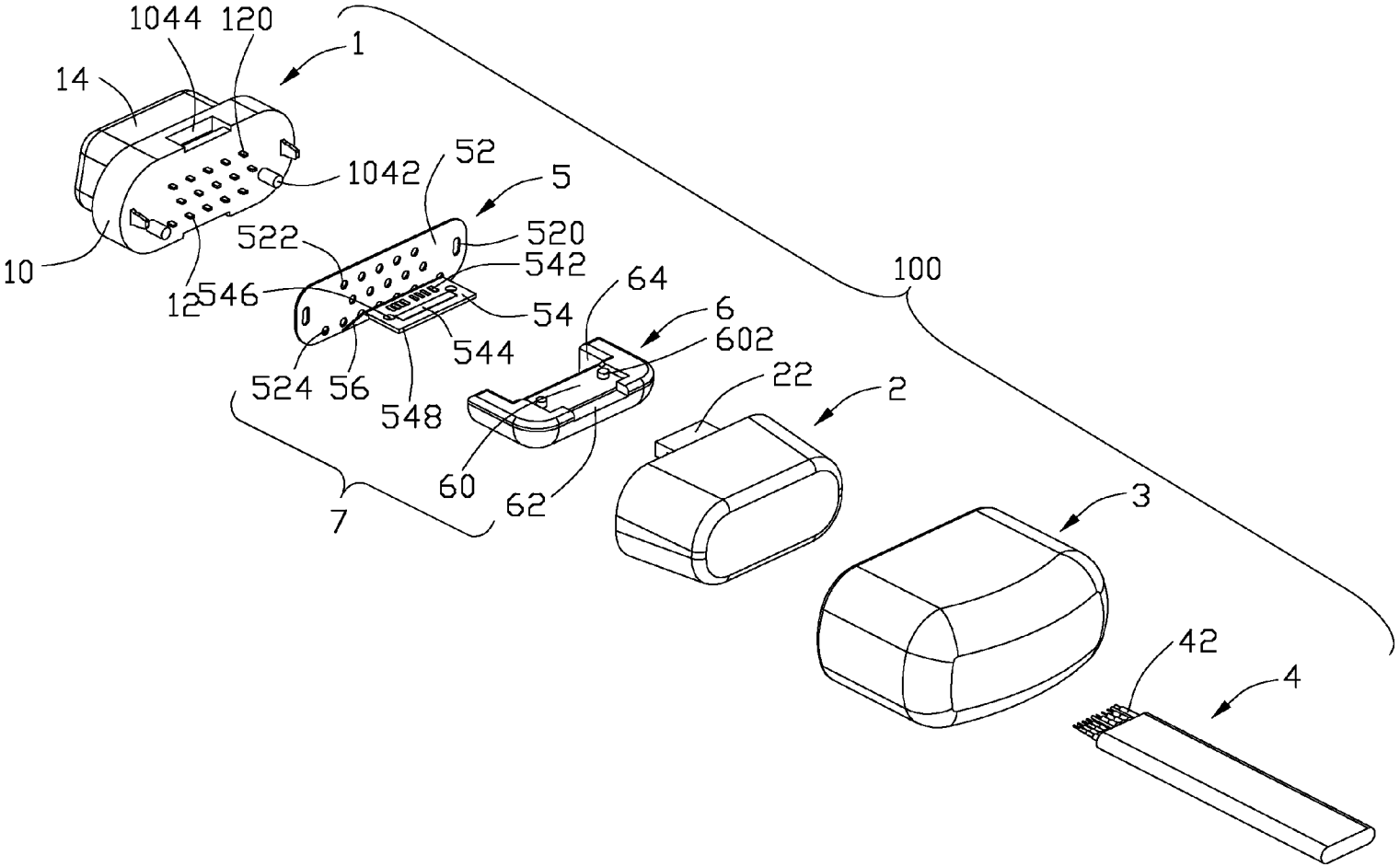
FIG. 2 is an exploded, perspective view of the cable assembly in according with the present invention.
Figure 3:
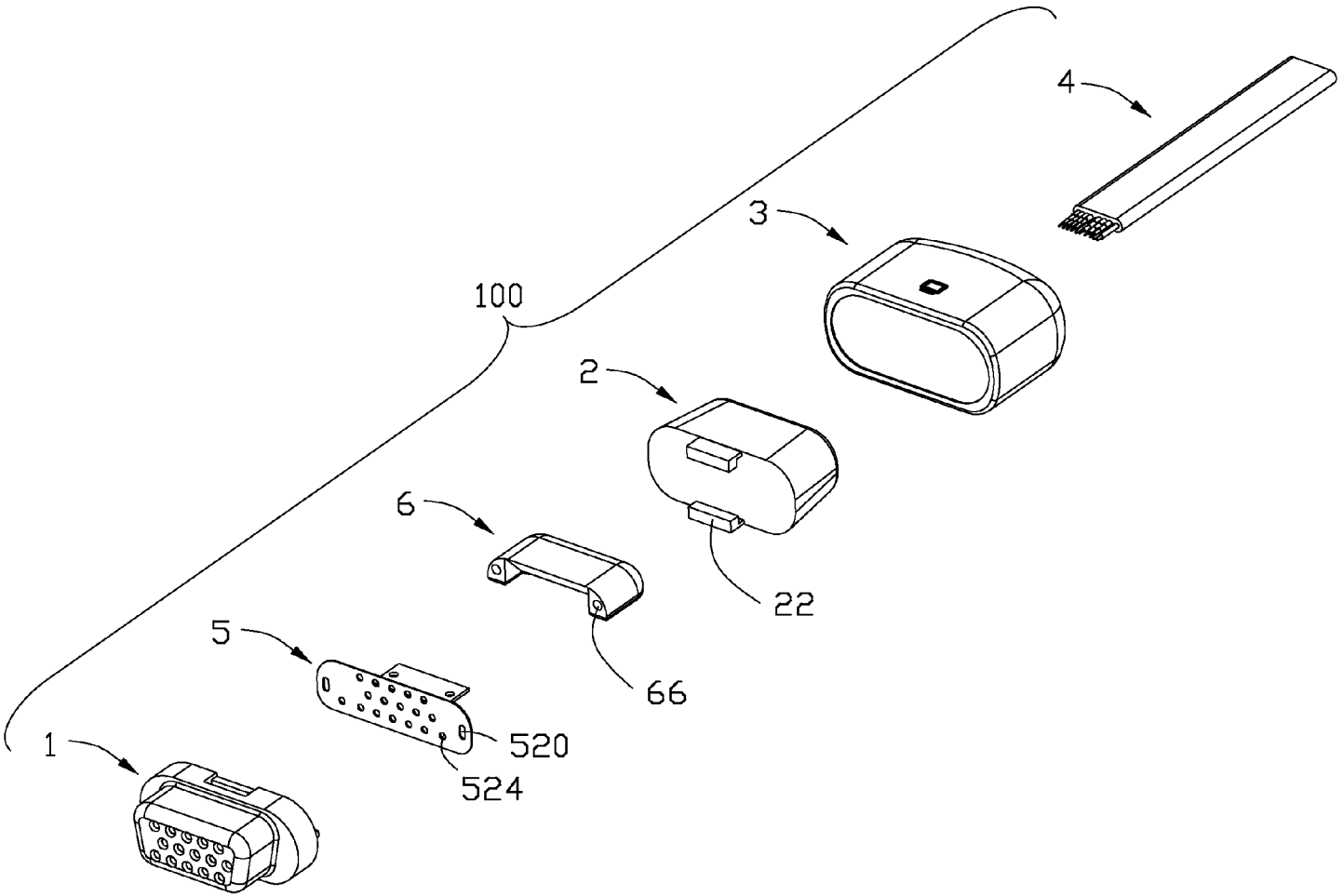
FIG. 3 is a view similar to FIG. 2, but taken from a different aspect.
Figure 4:
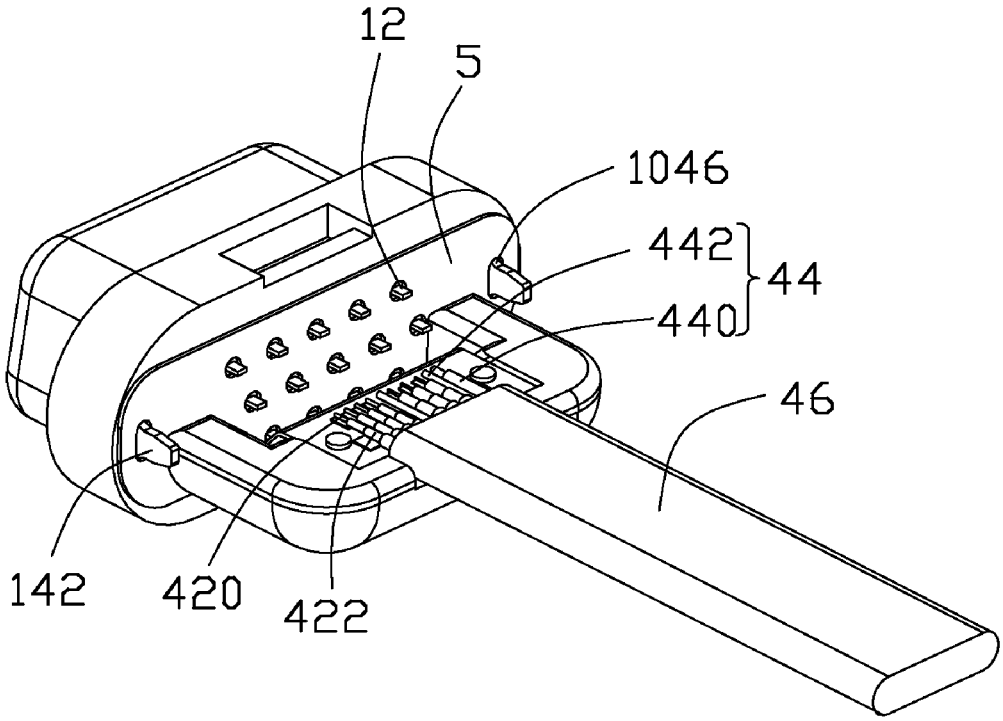
FIG. 4 is an assembled perspective view of an electrical connector, a flat cable, a flexible printed circuit and a spacer of the present invention.

Reference to FIG. 1 to FIG. 4, a cable assembly 100 in according with a preferred embodiment of the present invention is shown. The cable assembly 100 comprises an electrical connector 1, a flat cable 4, a flexible printed circuit (FPC) 5, a spacer 6, a first cover 2 and a second cover 3.

The electrical connector 1 comprises an insulation housing 10 with a plurality of receiving holes 102 and a plurality of terminals 12 receiving in the receiving holes 102 and each of which has an tail 120 exposed out of the housing 10. The housing 10 comprises a main body 104 and a mating portion 106 forwardly extending from the main body 104. The mating portion 106 is smaller than the main body 104 and has a shell 14 covering the mating portion 106 and assembled on the main body 104.

The flexible printed circuit 5 is electrically connected the flat cable to the electrical connector 1, and comprises a vertical connecting portion 52 connected to the terminals 12 of the electrical connector 1, a horizontal connecting portion 54 separated from the vertical connecting portion 52 and connected to one end of the flat cable 4, and a gradient connecting portion 56 connecting the vertical connecting portion to the horizontal portion. A strengthening board 548 is formed between the horizontal connecting portion 54 and the spacer 6 for increasing the rigidity of the horizontal connecting portion 54. The vertical connecting portion 52 comprises a plurality of holes 522 corresponding to the terminals 12 for make the terminals 12 pass through the hole 522 and electrically connected to the vertical connecting portion 52.

The spacer 6 is fastened on the electrical connector 10 for supporting the flexible printed circuit 5. The spacer 6 comprises a first vertical receiving space 60 receiving the horizontal connecting portion 54 of the flexible printed circuit 5 and the end of the cable 4, a second receiving space 64 receiving the gradient connecting portion 56, and a passageway 62 connecting the first receiving space 60 to make the cable 4 extend out the spacer 6. The passageway 62, the first receiving space 60, and the second receiving space 64 are arranged along a lengthwise direction. The insulation housing 10 comprises a pair of fastening poles 1042 arranged on two sides of the terminals 12. The vertical connecting portion 52 of the flexible printed circuit 5 comprises a pair of fastening holes 520 corresponding to the fastening poles 1042. The spacer 6 comprises a pair of fastening troughs 66 arranged on two sides of the second receiving space 64 and corresponding to the fastening poles 1042. The fastening poles 1042 can pass through the fastening holes 520 and be received in the fastening troughs 66 for fixing the spacer 6 to the electrical connector 1. The horizontal connecting portion 54 of the flexible printed circuit 5 comprises a plurality of pads 542 arranging in a line and a lengthwise grounding portion 544 separated from the pads 542 and a pair of holes 546 arranged between the pads 542 and the grounding portion 544. The spacer 6 has a pair of columns 602 formed in the first receiving space 60 thereof and corresponding to the holes 546. The columns 602 can insert into the holes 546 of the horizontal connecting portion 54 to fasten the horizontal connecting portion 54 on the spacer 6.

The cable 4 comprises a plurality of coaxial cables 42 and a plurality of wires 44. Each coaxial cable 42 comprises an inner conductor 420 connected to its corresponding pad 542 and an outer conductor 422 connected to the grounding portion 544. The wires 44 comprises a plurality of power wires 440 connected to their corresponding pads 542 and a plurality of grounding wires 442 connected to the grounding portion 544.

The first cover 2 is over-molded on the flexible printed circuit 5, the spacer 6 and the end of the cable 4. The insulation housing 10 of the electrical connector 1 comprising a pair of receiving grooves 1044 respectively arranged on an upper surface and a lower surface thereof The first cover 2 comprises a pair of fastening arms 22 fixed in the receiving grooves 1044. The second cover 3 is over-molded on the first cover 2 to cover the insulating housing 10 and the first cover 2.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable assembly, comprising: an electrical connector comprising an insulation housing and a plurality of terminals receiving in the housing and each of which has an tail exposed out of the housing; a flat cable; a flexible printed circuit electrically connecting the flat cable to the electrical connector, and comprising a vertical connecting portion connected to the terminals of the electrical connector and a horizontal connecting portion separated from the vertical connecting portion and connected to one end of the flat cable; and a spacer fastened on the electrical connector for supporting the flexible printed circuit; wherein said flexible printed circuit further comprises a gradient connecting portion connecting the vertical connecting portion to the horizontal portion; wherein said spacer comprises a first vertical receiving space receiving the horizontal connecting portion of the flexible printed circuit and the end of the cable, a second receiving space receiving the gradient connecting portion; wherein said spacer comprises a passageway connecting the first receiving space to make the cable extend out the spacer, and the passageway, the first receiving space, and the second receiving space are arranged along a lengthwise direction; wherein said horizontal connecting portion of the flexible printed circuit comprises a plurality of pads arranging in a line and a lengthwise grounding portion separated from the pads.

2. The cable assembly as claimed in claim 1, wherein said insulation housing comprises a pair of fastening poles arranged on two sides of the terminals, the vertical connecting portion of the flexible printed circuit comprises a pair of fastening holes corresponding to the fastening poles and the spacer comprises a pair of fastening troughs arranged on two sides of the second receiving space and corresponding to the poles, said fastening poles can pass through the fastening holes and be received in the fastening troughs for fixing the spacer to the electrical connector.

3. The cable assembly as claimed in claim 1, wherein said cable comprises a plurality of coaxial cables and a plurality of wires, said each coaxial cable comprises an inner conductor connected to its corresponding pad and an outer conductor connected to the grounding portion, the wires comprises a plurality of power wires connected to their corresponding pads and a plurality of grounding wires connected to the grounding portion.

4. The cable assembly as claimed in claim 3, wherein said horizontal connecting portion further comprises a pair of holes arranged between the pads and the grounding portion, the spacer has a pair of columns formed in the first receiving space thereof and corresponding to the two holes, the columns can insert into the two holes of the horizontal connecting portion to fasten the horizontal connecting portion on the spacer.

5. The cable assembly as claimed in claim 1, further comprising a first cover over-molded on the flexible printed circuit, the spacer and the end of the cable, the insulation housing of the electrical connector comprising a pair of receiving grooves respectively arranged on an upper surface and a lower surface thereof, the first cover comprising a pair of fastening arms fixed in the receiving grooves.

6. The cable assembly as claimed in claim 5, further comprising a second cover over-molded on the first cover to cover the insulating housing and the first cover.

7. The cable assembly as claimed in claim 1, further comprising a strengthening board located between the horizontal connecting portion of the flexible printed circuit and the spacer.

8. The cable assembly as claimed in claim 1, wherein said vertical connecting portion of the flexible printed circuit comprises a plurality of holes corresponding to the terminals for make the terminals pass through the hole and electrically connected to the vertical connecting portion.

9. A cable connector assembly comprising:

an insulative housing defining a front mating face and a rear mounting face away from the front mating face; a plurality of contacts disposed in the housing with mating sections and tail sections respectively around the front mating face and the rear mounting face; a flexible printed circuit board positioned behind the rear mounting face and having a front portion soldered to the tail sections of the contacts, and a rear portion mechanically and electrically connected to a plurality of wires;

a spacer attached to the housing and retaining the rear portion of the flexible printed circuit board; and an insulative cover enclosing the spacer and the flexible printed circuit board, and attached to the housing to cover the rear mounting face; wherein the front portion of the flexible printed circuit board extends vertically while the rear portion of the flexible printed circuit board extends horizontally and perpendicular to said front portion; wherein the spacer includes a post extending through the rear portion of the flexible printed circuit board for positioning the flexible printed circuit board to the spacer.

10. A cable connector assembly comprising: an insulative housing defining opposite front mating face and rear mounting face; a plurality of contacts disposed in the housing with mating sections around the mating face and tail sections around the mounting face; an insulative spacer attached to the housing; a flexible printed circuit board defining a front portion intimately abutting against the rear mounting face to mechanically and electrically connected to the tail sections, and a rear portion which is retained and supported by the spacer to mechanically and electrically connected to a plurality of wires; and an insulative cover enclosing the spacer, the flexible printed circuit board and the rear mounting face of the housing; wherein said rear portion of the flexible printed circuit board extends perpendicular to said front portion of the flexible printed circuit board; wherein the front portion of the flexible printed circuit board is sandwiched between the rear mounting face and the spacer.

* * * * *